US005752580A

United States Patent [19]

Jenkins, Jr.

[11] Patent Number: 5,752,580

[45] Date of Patent: May 19, 1998

[54] MODULAR LADDER SYSTEM

[76] Inventor: Joseph Robert Jenkins, Jr., 12203 Becontree Dr., Baton Rouge, La. 70810

[21] Appl. No.: 712,134

[22] Filed: Sep. 11, 1996

Related U.S. Application Data

[63] Continuation of Ser. No. 511,515, Aug. 4, 1995, abandoned, which is a continuation of Ser. No. 214,835, Mar. 17, 1994, Pat. No. 5,439,072.

[51] Int. Cl.[6] ..... E06C 1/10

[52] U.S. Cl. ..... 182/100; 182/93; 182/195

[58] Field of Search ..... 182/100, 93, 189, 182/195

[56] References Cited

U.S. PATENT DOCUMENTS

| | | | |
|---|---|---|---|
| 2,744,674 | 5/1956 | Smith | 182/189 |
| 2,827,216 | 3/1958 | Napolitano | 182/195 |
| 3,995,714 | 12/1976 | Brookes | 182/100 |
| 4,592,446 | 6/1986 | White | 182/100 |
| 5,277,273 | 1/1994 | Grimes | 182/194 X |
| 5,439,072 | 8/1995 | Jenkins, Jr. | 182/93 |
| 5,509,499 | 4/1996 | Prejean | 182/93 |

OTHER PUBLICATIONS

"Speed Steps", Submitted by Applicant in Related Apl. as Prior Art.

*Primary Examiner*—Alvin C. Chin-Shue

*Attorney, Agent, or Firm*—Warner J. Delaune

[57] ABSTRACT

A portable ladder module is provided, comprising a primary support member having a first step; a secondary support member having a second step, wherein the secondary support member is slidable relative to the primary support member. A lock is operatively disposed between the primary support member and the secondary support member for selectively locking the position of the secondary support member relative to the primary support member in an extended position and a retracted position. A strap having a quick-release buckle is secured to the primary support member for holding the ladder module to a tree, and a pair of rigid tubing members on each of the primary support member and the secondary support member are present for stabilizing the ladder module against the tree. Preferably, a third step is provided on either the primary or the secondary support member, depending upon the nature of the sliding relationship between the primary and secondary support members. Optionally, the first, second and third steps include retaining tabs, as well as upper and lower non-slip surfaces to prevent a climber's shoes from slipping off the ladder module.

8 Claims, 8 Drawing Sheets

MODULAR LADDER SYSTEM

RELATION TO COPENDING APPLICATION

This application is a continuation of application Ser. No. 08/511,515 filed on Aug. 4, 1995, abnd; which is a continuation-in-part of Ser. No. 08/214,835 filed on Mar. 17, 1994, now issued as U.S. Pat. No. 5,439,072.

BACKGROUND OF THE INVENTION

I. Field of the Invention

The present invention relates generally to ladders, and more particularly to modular ladder systems for climbing trees.

II. Description of Prior Art

In the sport of hunting, especially when the quarry is deer, the use of a tree stand is a very common practice. The tree stand offers many advantages, such as enabling the hunter to view his surroundings from an elevated vantage point, and minimizing the chances of being spotted or smelled by the deer. Therefore, development of tree stand technology to facilitate the achievement of these objectives has been quite progressive, focusing on both portability and adaptability. Despite the advances made in this filed, however, there still remains the problem of actually climbing the tree to set up the tree stand, and a number of prior techniques have been attempted with varying levels of success. Several of these devices are explained below, and each one offers the hunter a unique balance of portability, strength, stability and adaptability to the tree-climbing environment.

The simplest ladder known in the prior art, other than simply using the branches of the tree, is the conventional ladder having two parallel members connected by perpendicular rungs. Whether such a ladder has a unitary construction or is an extension ladder, it is extremely cumbersome for carrying through dense woods and is oftentimes quite heavy. Also, such ladders are necessarily straight and may not be well suited for use with a tree having an irregular shape. Finally, under the adverse conditions presented by most hunting environments, a conventional ladder is typically unstable and dangerous.

To overcome the problem of portability associated with conventional ladders, a number of alternative designs have been attempted. Some devices simply include two or more sections or modules of conventional ladder design which connect end-to-end, and the resulting assembly is tied to the tree to improve stability. While these designs made headway in improving portability, they remain ill-suited for use with trees having an irregular axis or many low branches which interfere with the long straight-line distance that the ladder is meant to span.

Another alternative design also comprises a number of connected modules, where each module has a single vertical member from which several steps are placed perpendicularly thereto. Some models have the steps offset from one another, such as in the case of the "Po-Jo Climbing Pole" manufactured by Amacker International, Inc., in Delhi, La. In other models, the steps are formed in a continuing T-configuration with respect to the vertical member, as seen in the "Sky Ladder" manufactured by Loc-On Company in Greensboro, N.C. The assembled ladder is then either tied to the tree with a rope or strap, or attached to the tree by a set of metal tongs. One of the advantages of such devices are that they are more lightweight than those ladders employing parallel vertical members. In those ladders where the steps are arranged in a continuing T-configuration, another purported advantage is that the climber is afforded the ability to place both feet on the same level while climbing, resulting in a more comfortable and stable climb.

Despite their apparent advantages, none of the above devices have addressed the problem of trees which have: (1) so-called "bell bottoms", or unusually wide trunks, such as cypress and tupelo trees typical in the southern United States; (2) a main vertical axis which is very irregular; or (3) many low-level branches which do not allow for a continuous ladder spanning a large distance to the tree stand.

However, the ladder modules marketed under the trademark "Speed Steps" by Alumitech Industries, Inc., in Mamou, La., are an attempt to overcome those unique concerns. That ladder system is essentially a number of mini-ladders of conventional design which are separately attachable to the tree, except that the tips of the parallel rails at both ends are curved toward the tree to provide a four-point contact. While it is an improvement over prior devices to some extent, several weaknesses are apparent. First, the double-rail design does not allow the climber to place both feet on the same level at some point on the module, and is somewhat bulky when carried with other modules. Second, the modules are not internally adjustable in any way, so they cannot make maximum use of the existing tree structure, and they cannot be made more compact for storage and transportation. What is needed, therefore, is a modular tree ladder system which is conveniently portable, strong, stable, and adaptable to a variety of tree climbing environments.

SUMMARY OF THE INVENTION

It is therefore an object of this invention to provide a portable tree ladder system which is strong, compact and lightweight.

It is also an object of this invention to provide a portable tree ladder system which is highly adaptable to the particular tree climbing situation.

It is a further object of this invention to provide a portable tree ladder system whose modules are adjustable in length.

Yet another object of this invention is to provide a portable tree ladder system which is safe and stable when used.

These and other objects and advantages of the present invention will no doubt become apparent to those skilled in the art after having read the following description of the preferred and alternate embodiments, which are contained in and illustrated by the various drawing figures.

Therefore, a portable ladder module is provided, comprising a primary support member having a first step; a secondary support member having a second step, wherein said secondary support member is slidable relative to said primary support member; locking means operatively disposed between said primary support member and said secondary support member for selectively locking the position of said secondary support member relative to said primary support member in an extended position and a retracted position; means on said primary support member for holding said ladder module to a tree; and means on said primary support member and said secondary support member for stabilizing said ladder module against said tree. Preferably, a third step is provided on either the primary or the secondary support member, depending upon the nature of the sliding relationship between the primary and secondary support members. Optionally, the first, second and third steps include retaining tabs, as well as upper and lower non-slip surfaces to prevent a climber's shoes from slipping off the ladder module.

DETAILED DESCRIPTION OF THE INVENTION

Figure 1:
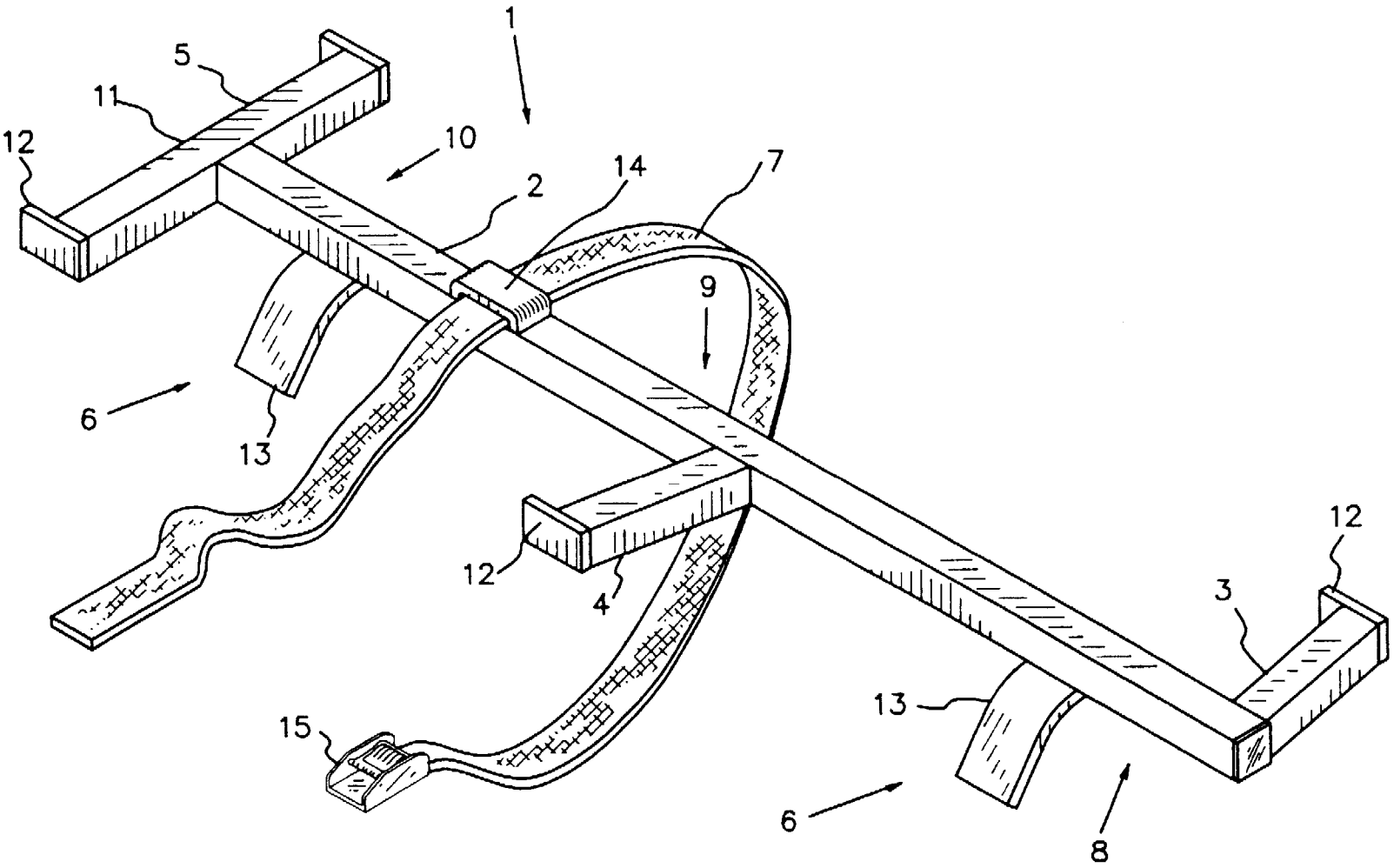
FIG. 1 is a perspective view of a preferred embodiment of the invention.

In the drawings many details pertaining to fabrication and maintenance utility well established in the machine construction art and not bearing upon points of novelty are omitted in the interest of descriptive clarity and efficiency. Such details may include threaded connections, lockrings, shear pins, weld lines and the like. Also, the spreading use of electron beam welding eliminates many such features and leaves no visible distinctive lines.

Turning now to FIG. 1, a tree ladder module 1 is shown generally comprising a support member 2, first and second steps 3, 4, top step 5, stabilizing means 6, and strap 7. Support member 2 preferably consists of a straight, rigid section of aluminum tubing having a lower end 8, a middle portion 9, and an upper end 10. In keeping with the goal of being lightweight and strong, the cross section of support member 2 has square dimensions of 1¼"×1¼" with a wall thickness of 1/16". The overall length of ladder module 1 is approximately three feet (3'), which makes it quite easy to be carried during a hunting trip, but can be manufactured to any length.

First and second steps 3, 4 are simply short sections of aluminum tubing attached to lower end 8 and middle portion 9, respectively, preferably by welding. As shown best in FIGS. 2A and 2B, the angle A between first and second steps 3, 4 and support member 2 should be less than 90 degrees so that a foot can be wedged therein during climbing. Top step 5 is also constructed of aluminum tubing and is perpendicularly attached at its midpoint 11 to upper end 10 of support member 2. For reasons of safety, it is preferable for first and second steps 3, 4 and top step 5 to include retaining tabs 12 rigidly attached to the ends of each step. Retaining tabs 12, along with the inclined angle of first and second steps 3, 4, help to prevent slippage of the climber's shoe from the ladder module 1 during climbing. Advantageously, top step 5 permits the climber to place both boots on the same level when standing on top of ladder module 1. As an added safety feature, first and second steps 3, 4 and top step 5 should also include a upper non-slip, or abrasive, surface (not shown) for contact with the climber's sole of the shoe or boot. This non-slip surface can be added by any one of several methods widely known to those of ordinary skill, such as by an abrasive paint, an adhesive strip having embedded abrasive material, or by forming irregularities into the steps during manufacturing.

Figure 2A:
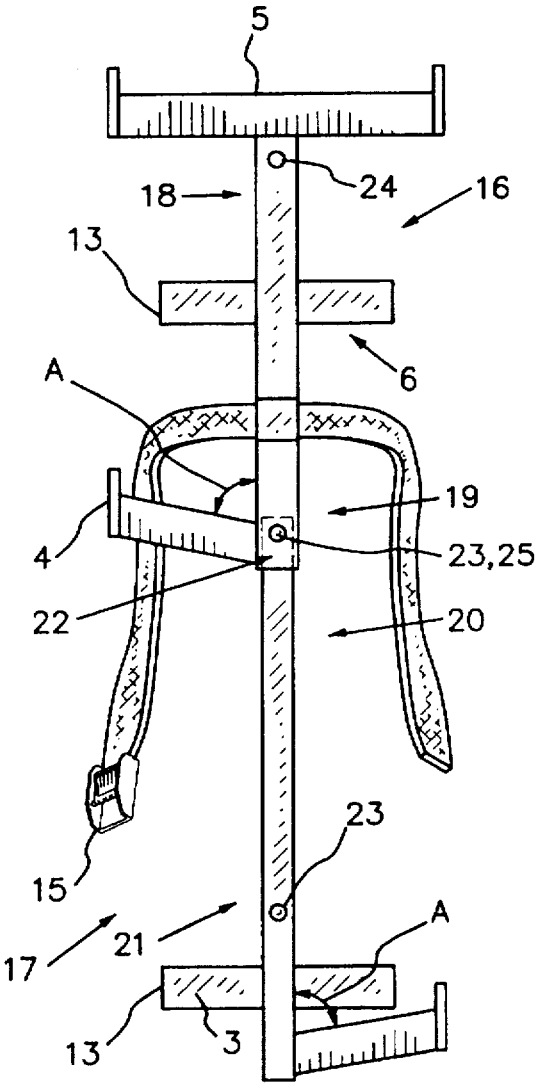
FIGS. 2A and 2B are side views of an alternate embodiment of the invention which is adjustable.
Figure 2B:
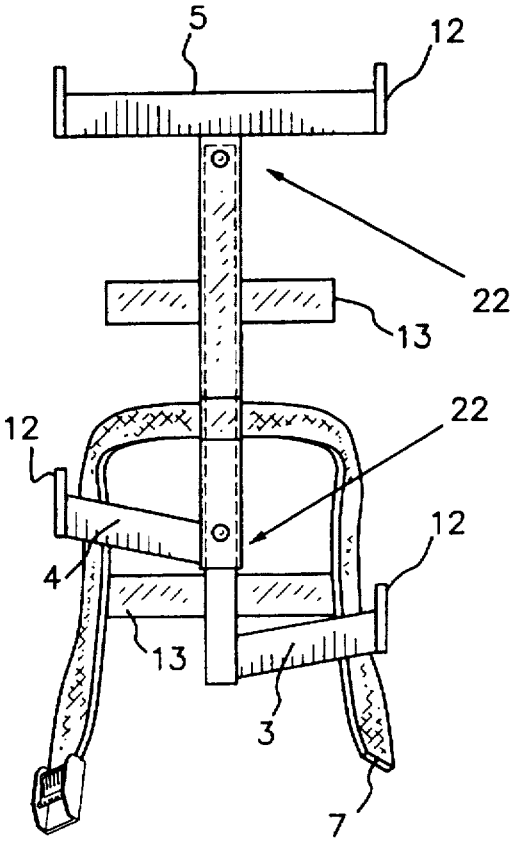

To ensure that ladder module 1 is anchored firmly to the tree and to provided a means for spacing the ladder module 1 away from the tree to leave room for the climber's shoes, stabilizing means 6 is attached to support member 2. As shown in FIGS. 1, 2A, and 2B, stabilizing means 6 is comprised of a pair of curved sections of aluminum channel stock 13 welded to the upper end 10 and lower end 8 of support member 2. Channel stock 13 consists of an elongated, flat portion having two extending parallel edges, and is curved into a C-shape so that the extending parallel edges conform roughly to the curvature of the tree to be climbed. Channel stock 13 is attached to upper and lower ends 8, 10 of support member 2 along the flat portion opposite the parallel edges. Providing at least two such points of contact against the tree prevents the ladder module 1 from moving relative to the tree and creates a more stable structure. Strap 7 is held to ladder module 1 by a loop 14 permanently attached to upper end 10 of support member 2, and is long enough to completely wrap around the tree to be climbed. A self-tightening, quick-release buckle 15 is included which ensures that ladder module 1 will remain attached to the tree during climbing when strap 7 is placed in tension.

In the alternate embodiment depicted in FIGS. 2A and 2B, an adjustable ladder module 1 is provided whose length can be changed to suit the needs of the user. This embodiment is very similar to the one described above, but generally comprises a hollow, primary support member 16 into which a secondary support member 17 is telescopingly slidable. Primary support member 16 can be constructed from the same material as in the preferred embodiment, and includes an upper end 18 and a lower end 19, as well as a loop 14, strap 7, and buckle 15 as described earlier. Primary support member 16 should have a length of approximately 20 inches. Second step 4 is a short section of aluminum tubing attached at the lower end 19 of primary support member 16, while top step 5 is attached at its midpoint 11 to the upper end 18 of primary support member 16. A part of the stabilizing means 6, namely channel stock 13, is also attached at its flat portion to primary support member 16. Retaining tabs 12 are included on the end of second step 4 and both ends of top step 5 to prevent slippage of the climber's boot during climbing.

Secondary support member 17 also includes an upper end 20 and a lower end 21, and it is constructed of the same material as primary support member 16. The length of secondary support member 17 should be approximately 20 inches. However, it must be of a cross section which will slide into and out of primary support member 16. Preferably, there should be a relatively tight fit between primary and secondary support members 16, 17, so that when the ladder module 1 is in an extended position, there will be little movement between primary and secondary support members 16, 17. First step 3 is attached to lower end 21 of secondary support member 17 in the same manner as in the preferred embodiment. The complementary portion of stabilizing means 6, in the form of channel stock 13, is attached along its flat portion to the distal portion of lower end 21 of secondary support member 17. As in the case of second step 4 and top step 5, retaining tab 12 is also included on the end of first step 3 as a safety measure.

In a retracted position as shown in FIG. 2B, secondary support member 17 is held almost entirely within primary support member 16 by locking means 22. Locking means 22 can be any device which effectively prevents secondary support member 17 from sliding out of primary support member 16, such as a nut and bolt combination, or a spring loaded pin 23. If spring loaded pin 23 is employed, primary support member 16 will include first lock hole 24 at its upper end 18, and a second lock hole 25 at its lower end 19. Spring loaded pins 23 are located on secondary support member 17 at a distance apart to match with first and second lock holes 24, 25 in a retracted position. In an extended position as shown in FIG. 2A, spring loaded pin 23 at the upper end 20 of secondary support member 17 will engage second lock hole 25 of primary support member 16. The relative locations of second lock hole 25 and spring loaded pin 23 on the upper end 20 of secondary support member 17 should be such that at least three inches (3") of secondary support member 17 should remain within primary support member 16.

Figure 3A:
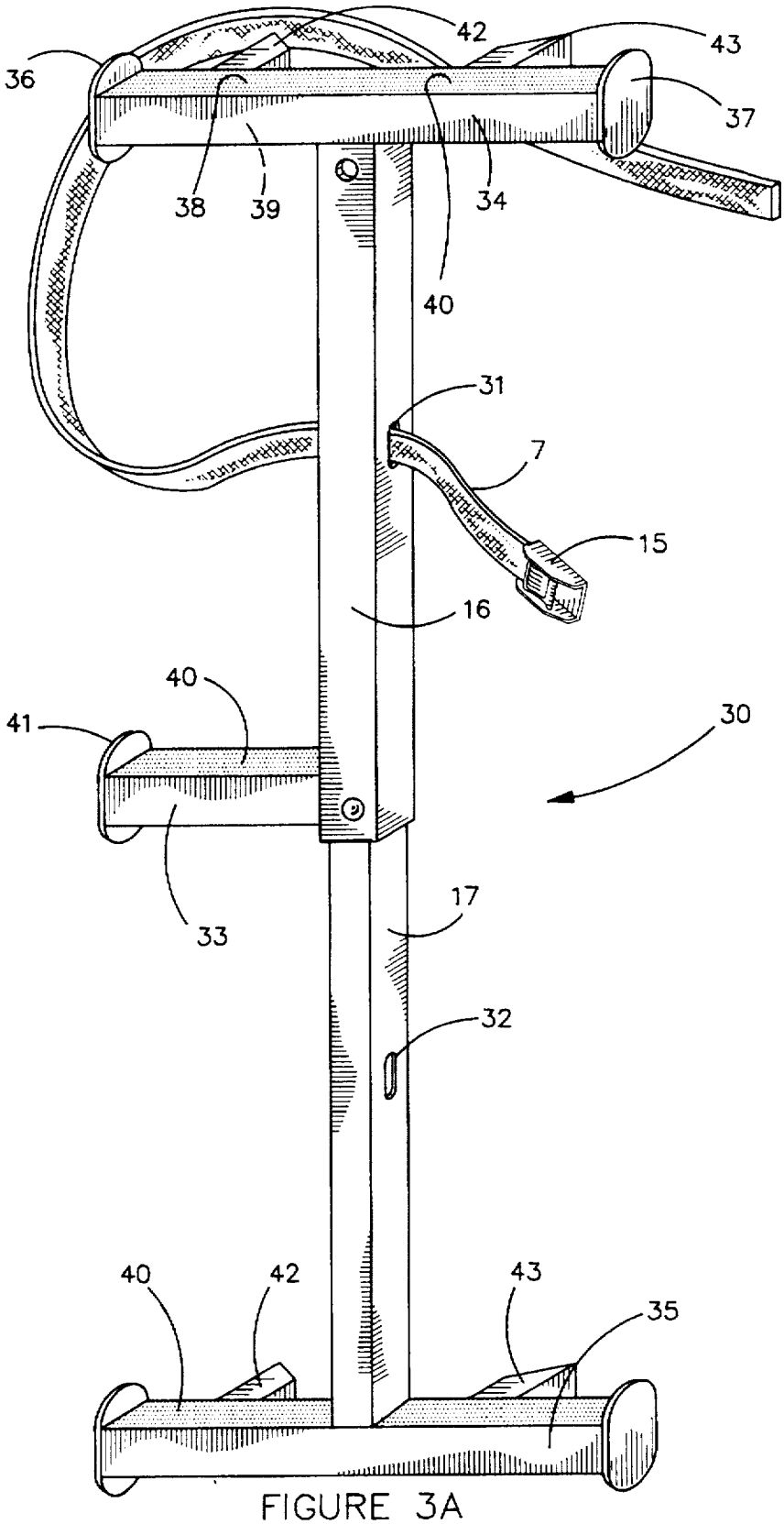
FIGS. 3A and 3 are perspective views of another alternative embodiment of the invention which can be attached to a tree in an upright or inverted position.
Figure 3B:
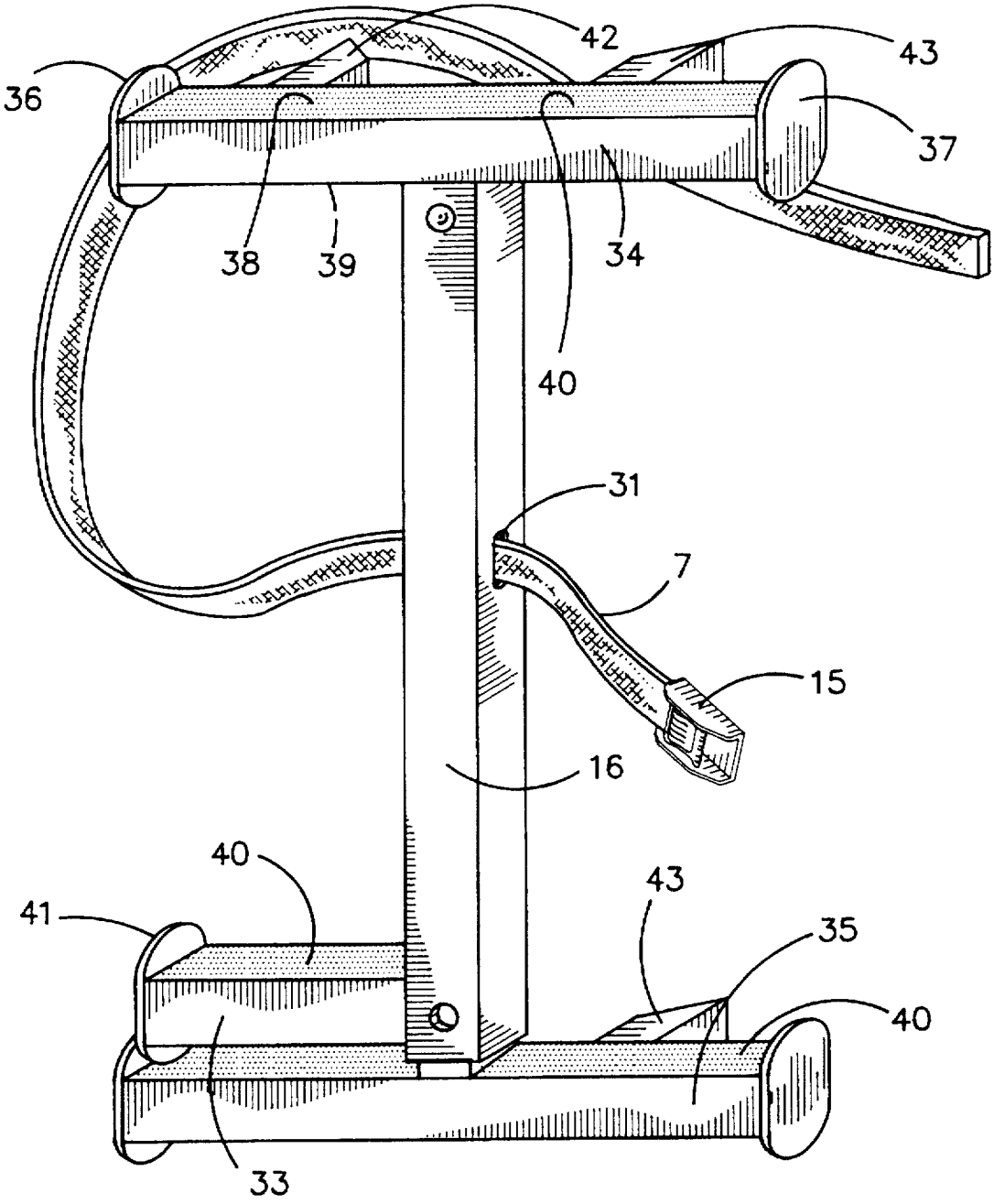

Another alternative embodiment 30 of the invention is depicted in FIGS. 3A and 3B which can be used in either an upright or inverted orientation, as will be explained below. This embodiment is similar in many respects to the embodiment of FIGS. 2A and 2B, and corresponding part numbers are used where applicable. Loop 14 is replaced by upper slot 31 formed completely through primary support member 16, and is located at approximately the midpoint of the length of primary support member 16. Thus, as can be seen in FIG. 3A, a single strap 7 (such as that shown in FIGS. 1, 2A, and 2B) may be passed through upper slot 31 to secure the ladder module 30 in an extended position to a tree 29.

Additionally, lower slot 32 is formed completely through secondary support member 17 and is located at approximately the midpoint of the length of secondary support member 17. Importantly, the precise locations of upper slot 31 and lower slot 32 along their respective support members 16, 17 are such that lower slot 32 becomes horizontally aligned with upper slot 31 when secondary support member 17 is retracted and locked into primary support member 16. Therefore, the ladder module 30 is easily securable to a tree by passing strap 7 through aligned slots 31–32 in a retracted position, as shown in FIG. 3B.

From the foregoing description, it can be seen that strap 7 may be passed only through lower slot 32 if desired, so that ladder module 30 can be used with equal effectiveness in an extended position, but in an "inverted" (as opposed to an "upright") orientation. For the purposes of this description, "upright" is defined as an orientation of ladder module 30 wherein primary support member 16 resides above secondary support member 17. Conversely, "inverted" is defined as an orientation of ladder module 30 wherein primary support member 16 resides below secondary support member 17. Similarly, ladder module 30 can be secured to a tree 29 in an inverted and retracted position for the same reasons explained above. Thus, the versatility of ladder module 30 is greater than that of the previously described embodiments.

Consistent with the ability of ladder module 30 to be used in an inverted position, the top step 34 and bottom step 35 are identical to one another. For example, top step 34 is wide enough to accommodate both shoes of a climber and is perpendicularly attached at its midpoint to the distal end of primary support member 16, as shown in FIG. 3A. Retaining tabs 36, 37 are affixed to both ends of top step 34 and extend beyond the upper and lower surfaces 38, 39. Likewise, the upper and lower surfaces 38, 39 of top step 34 include a non-slip or abrasive surface 40 so that a climber can have sure footing on ladder module 30 in either an upright or inverted position. Bottom step 35 includes identical features, but is perpendicularly attached at its midpoint to the distal end of secondary support member 17. Middle step 33 is attached to the proximal end of primary support member 16 in a manner that provides level footing in either an upright or inverted position. Therefore, middle step 33 is not inclined in the manner of second step 4 of FIGS. 2A and 2B. Similar to both top step 34 and bottom step 35, middle step 33 also includes upper and lower non-slip surfaces 40, as well as a retaining tab 41 identical to retaining tabs 36, 37.

Stabilizing means 6 in FIGS. 3A and 3B differs from that of the previous embodiments in that it comprises a pair of pointed tubing sections 42, 43 extending from both top step 34 and from bottom step 35. Providing at least four points of contact against the tree 29 prevents the ladder module 30 from moving relative to the tree 29 and creates a more stable structure. In addition, the use of tubing sections 42, 43 on top and bottom steps 34, 35 results in a more compact ladder module 30 when placed in a retracted position.

Figure 4:
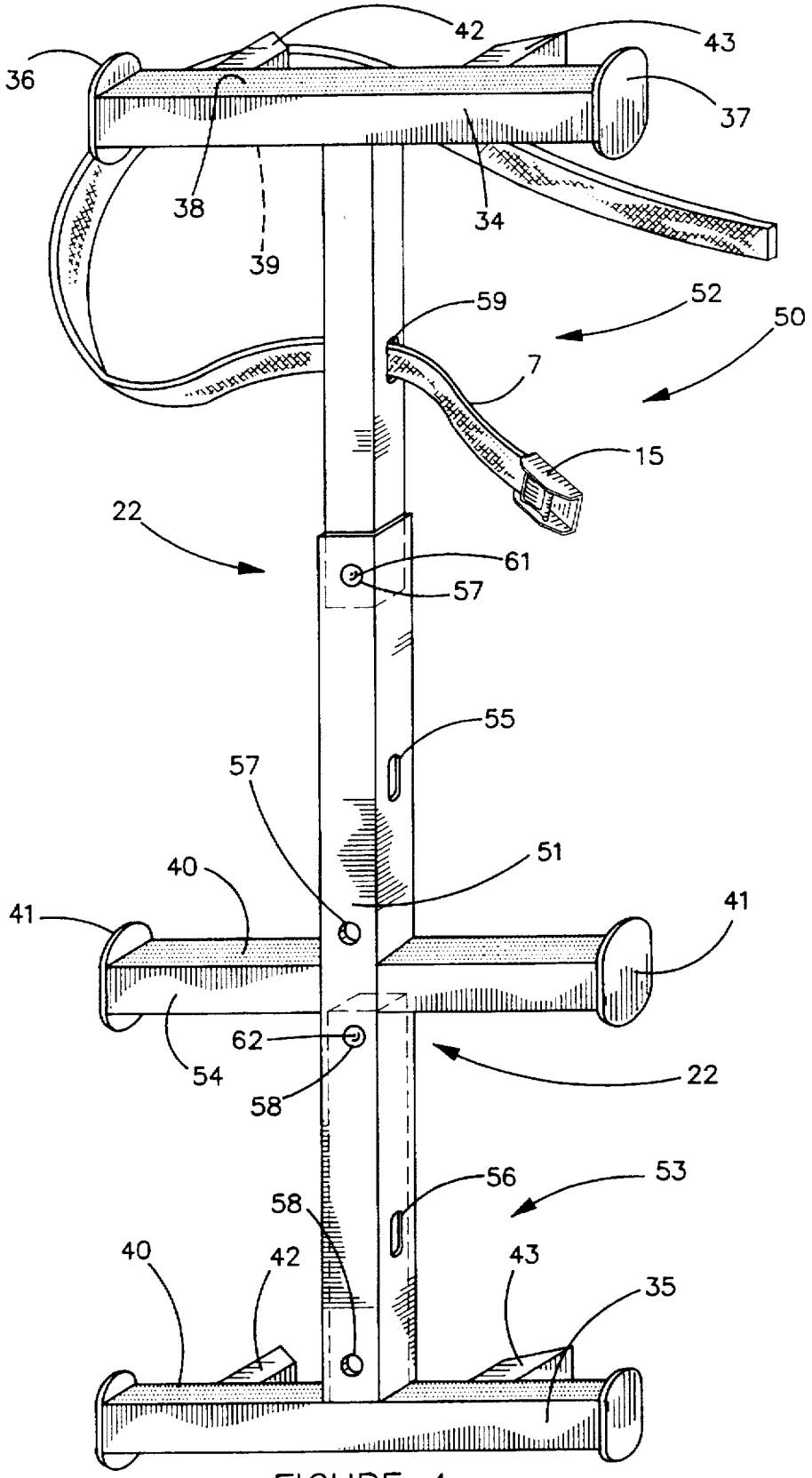
FIG. 4 is a perspective view of a further alternative embodiment of the invention which includes two adjustable portions.

A further alternative embodiment 50 of the invention is shown in FIG. 4 which includes two separately adjustable portions. This embodiment is similar in many respects to the embodiment 30 of FIGS. 3A and 3B, and corresponding part numbers are used where applicable. Central support member 51 is constructed of lightweight, aluminum tubing having a hollow cross-section sized to slidably mate with upper support member 52 and lower support member 53. It will be appreciated that the designations of support member 52, 53 as "upper" and "lower" are made solely for the purposes of this description, as this embodiment 50 may be used in either an upright or inverted orientation as explained previously herein. Thus, upper and lower support members 52, 53 are identical in construction and function, except that upper support member 52 is placed within one end of central support member 51, while lower support member 53 is placed within the opposite end of central support member 51 as shown in FIG. 4.

Middle step 54 extends perpendicularly from the approximate midpoint of central support member 51 and includes retaining tabs 41 on each end, as well as upper and lower non-slip surfaces 40. Central slots 55, 56 are formed completely through central support member 51, and are located above and below middle step 54, respectively. Preferably, central slot 55 is formed roughly halfway between middle step 54 and the upper end of central support member 51, whereas central slot 56 is formed symmetrically opposite central slot 55. Locking means 22 is also present in this embodiment 50 through the use of upper lock holes 57 and lower lock holes 58 formed into central support member 51. Upper lock holes 57 are located along central support member 51 to correspond to retracted and extended positions of upper support member 52. Likewise, lower lock holes 58 are located along central support member 51 to correspond to retracted and extended positions of lower support member 53. Spring-loaded pins 61, 62 are located on upper and lower support members 52, 53, respectively, to mate with the appropriate lock holes 57, 58 in either a retracted or extended position.

Referring specifically to upper support member 52 in FIG. 4, upper slot 59 is formed through approximately the midpoint of the length of upper support member 52. Thus, a single strap 7 may be passed through upper slot 59 to secure the ladder module 50 in an extended position to a tree 29. Similar to the previous embodiment 30, the precise locations of upper slot 59 and central slot 55 along their respective support members 52, 51 are such that upper slot 59 becomes aligned with central slot 55 when upper support member 52 is retracted and locked into central support member 51. Therefore, the ladder module 50 is easily securable to a tree 29 by passing strap 7 through aligned slots 55, 59 when upper support member 52 is in a retracted position. As stated earlier, lower support member 53 is identical in construction to upper support member 52. Therefore, the locking of lower support member 53 in either a retracted or extended position, as well as the possible placements of strap 7, are perfectly symmetrical to upper support member 52.

In the interest of keeping this embodiment 50 as compact, yet versatile, as possible, it is preferable that its maximum length be kept below about 37 inches long when both upper and lower support members 52, 53 are extended. Depending upon the relative lengths of central support member 51 and upper and lower support members 52, 53, as well as the exact locations of pins 61, 62 and lock holes 57, 58, the overall length of this embodiment 50 will be approximately 21 inches long when both upper and lower support members 52, 53 are both retracted. Due to its symmetry, it can be seen that this embodiment 50 may also be used in either an inverted or upright orientation, and that the ability to extend or retract either end offers a degree of versatility and maneuverability to climbers heretofore unknown in this industry.

Figure 5B:
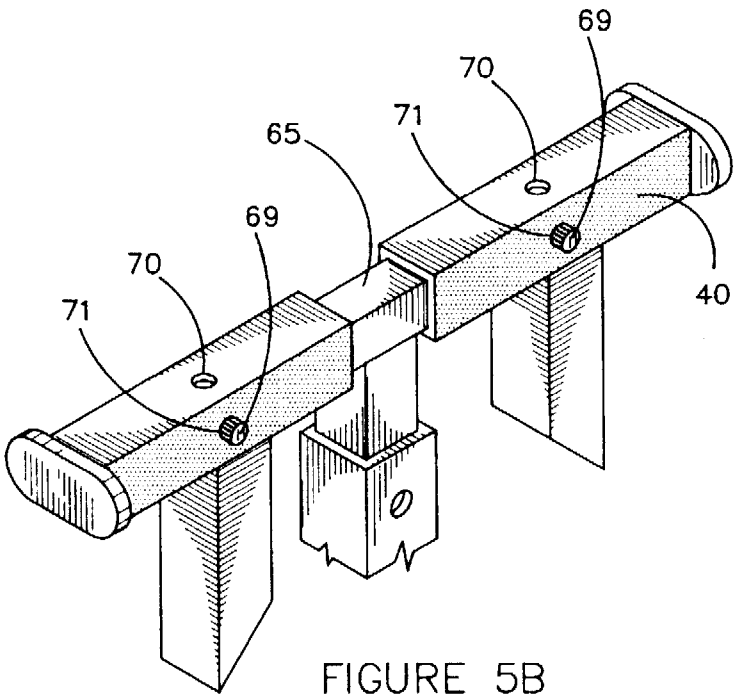
FIG. 5A and 5B depict two positions of the optional adjustable steps for the invention.
Figure 5A:
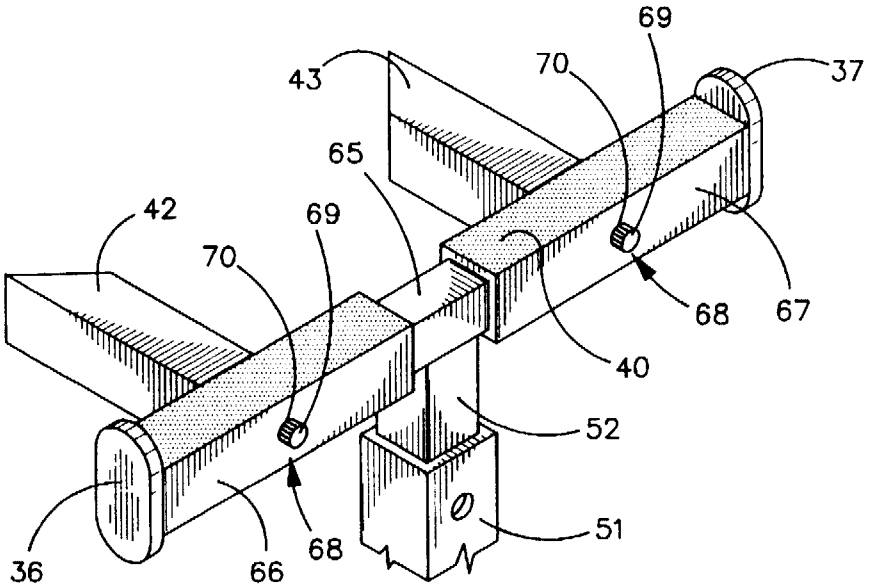

Finally, FIG. 5A and 5B depict two positions of an alternate step design which may be used with any of the foregoing embodiments. However, the following description will use the embodiment 50 of FIG. 4, and specifically the upper support member 52, as an example of these modifications. Top step 34 is replaced by a hollow square tube 65 which is permanently attached to upper support member 52 and which extends in cantilever fashion from both sides of upper support member 52. A pair of identical step assemblies 66, 67 are removably and slidably mounted on tube 65 and include pointed tubing sections 42, 43, respectively, as shown. Step assemblies 66, 67 have square internal cross-sections which closely match the external cross-section of tube 65, and the outer surfaces of step assemblies 66, 67 are square, or polygonal, in shape. The movement of step assemblies 66, 67 is restrained by step locking means 68 disposed between each of step assemblies 66, 67 and tube 65. Step locking means 68 may simply comprise a spring-loaded pin 69 affixed within tube 65 which lockingly mates with corresponding holes 70, 71 on each of step assemblies 66, 67.

For safety reasons, the location of pins 69 should be such that a climber will not inadvertently depress a pin 69 during a climb. In a preferred version, step assemblies 66, 67 are thus adjustable between an operating position (in which tubing sections 42, 43 are directed perpendicularly away from upper support member 52) and a collapsed position (in which tubing sections 42, 43 are essentially parallel with upper support member 52). Non-slip surfaces 40, as well as retaining tabs 36, 37, are also present on step assemblies 66, 67 as shown in FIGS. 5A and 5B. It can be seen that the adjustable step assemblies 66, 67 just described allow the hunter to stack and transport several ladder modules in a more compact manner. If the foregoing step design is applied to the embodiments of FIGS. 1, 2A and 2A, it would be advantageous to remove the excess stabilizing means 13 from those embodiments so that such benefits can be fully realized.

Figure 6:
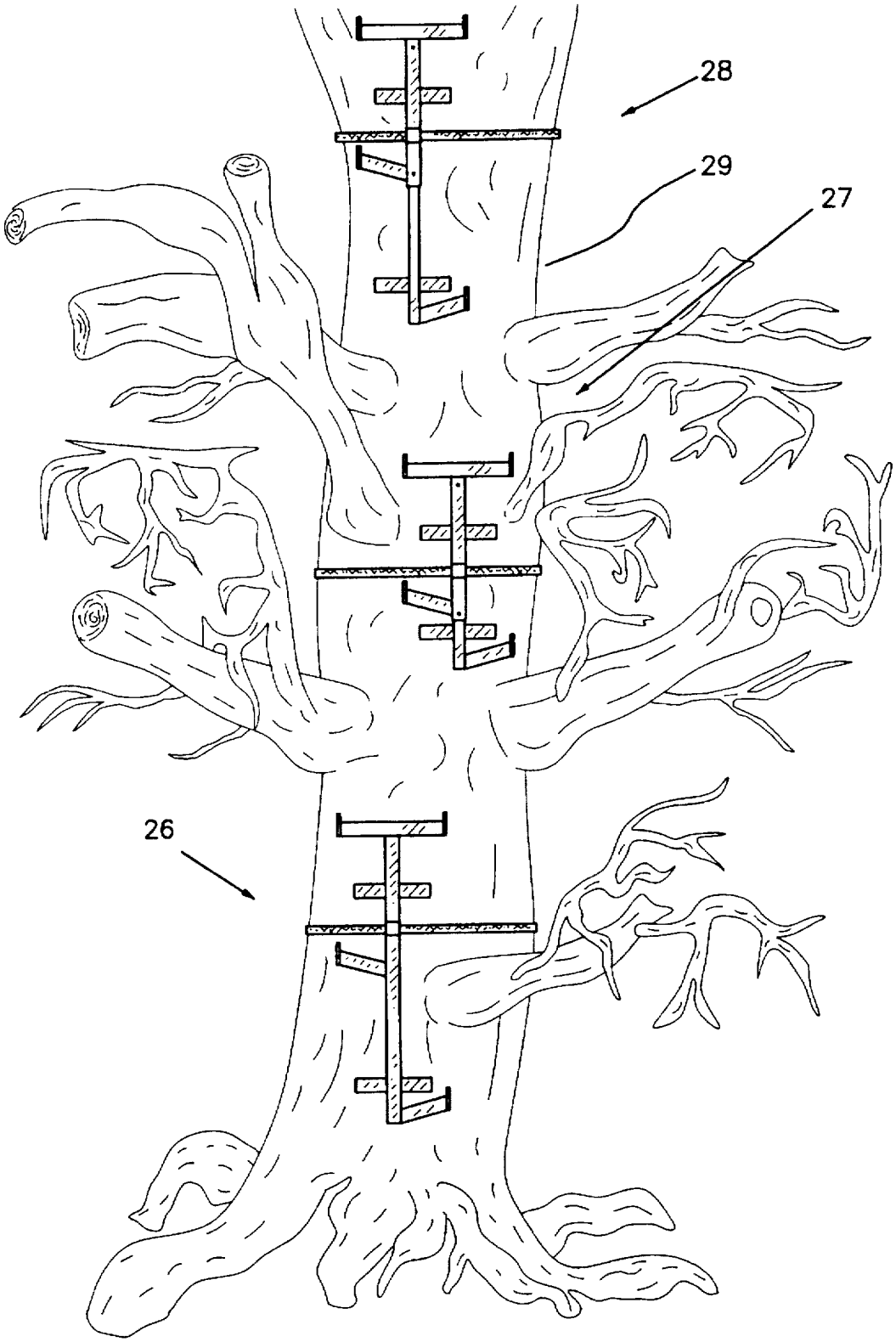
FIG. 6 depicts several ladder modules of the invention attached to a tree.
Figure 7:
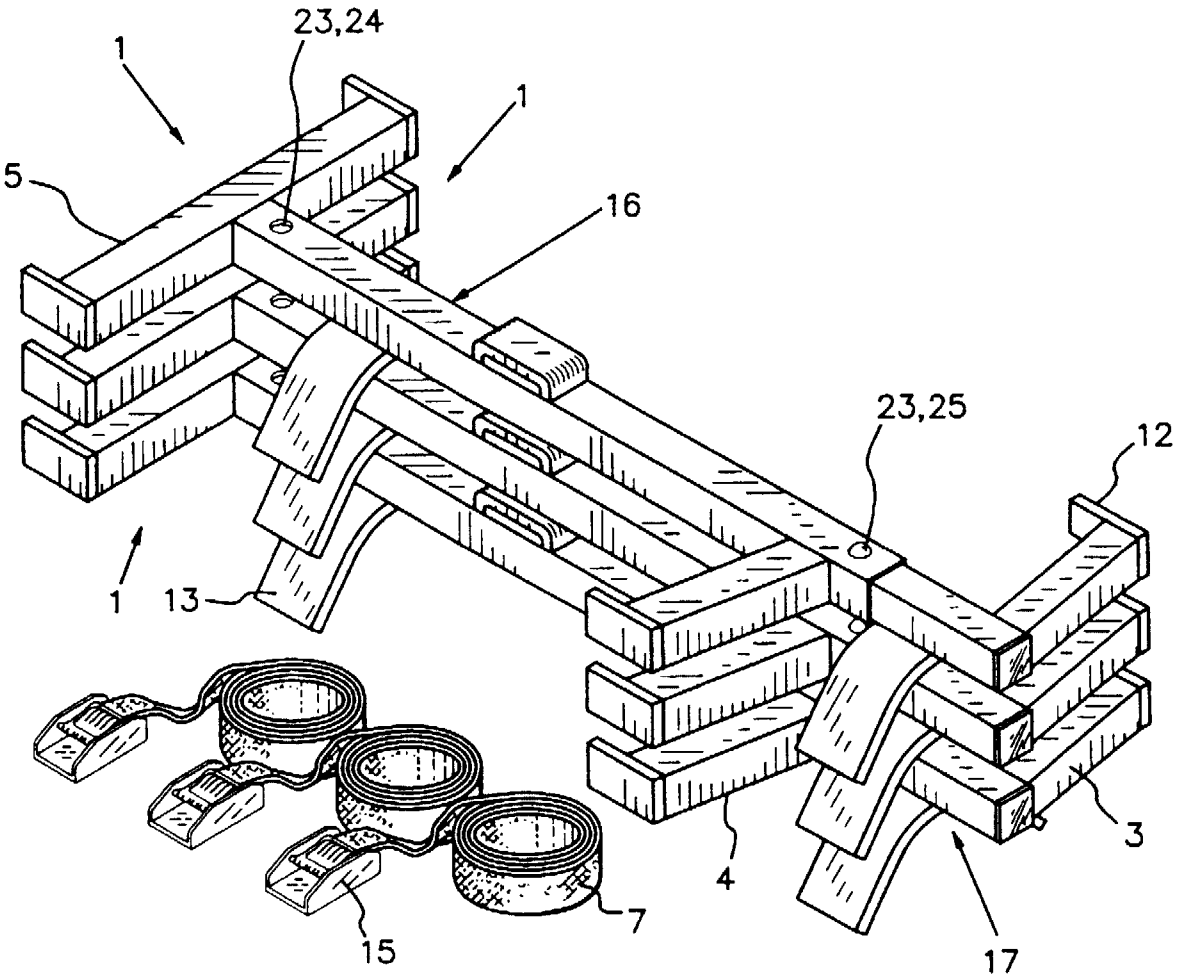
FIG. 7 shows several of the ladder modules depicted in FIGS. 2A and 2B in a stacked configuration for transportation.

In operation of the invention, FIG. 6 shows three ladder modules attached to a tree 29. The bottom ladder module 26 is constructed in accordance with the preferred embodiment of FIG. 1, while the middle ladder module 27 and top ladder module 28 are constructed in accordance with the alternate embodiment of FIGS. 2A and 2B, in retracted and extended positions, respectively. It will be appreciated that the ability of the ladder module to retract and extend offers advantages to hunters for at least two important reasons. First, as shown in FIG. 7, it is much easier to transport multiple ladder modules to and from a hunting site when the ladder modules are in a retracted position. This is particularly true if the step assemblies 66, 67 of FIGS. 5A and 5B are employed. Second, based on the particular branch structure of the tree to be climbed, the climber has the option of either extending or retracting the ladder modules of his choice to make maximum use of the tree branches and/or the ladder modules.

The overall concept of the foregoing embodiments of the invention is directed to providing a ladder system having a low-profile design for ease of carrying and storage. This design also helps the hunter in achieving a totally camouflaged appearance, because it is smaller and less bulky than competing designs. Furthermore, the thin structural components enable the ladder modules to be placed within very tight spaces among tree limbs, contrary to double-rail designs seen in the prior art. Also, when providing the same number of steps as prior art double-rail designs, the present invention is actually shorter in length than the prior art, even when fully extended, because the 4-point contact with the tree is made between the steps. Finally, the embodiments of FIGS. 3A, 3B, and 4 permit the ladder module to be placed in either an upright or inverted position.

Although the present invention has been described in terms of specific embodiments, it is anticipated that alterations and modifications thereof will no doubt become apparent to those skilled in the art. For example, the embodiments shown in FIGS. 2A, 2B, 3A, and 3B depict the secondary support member 17 as sliding within the primary support member 16. However, only slight modifications would be required to cause primary support member 16 to slide within secondary support member 17, such as moving the middle step 4 or middle step 33 to secondary support member 17 and changing the tubing cross section of primary support member 16 to be smaller than that of secondary support member 17. Similar modifications might be made to the embodiment of FIG. 4 in that the central support member 51 might be sized with a smaller cross-section that both upper and lower support members 52, 53, and wherein the central support member 51 is caused to slide within both upper and lower support members 52, 53. It is therefore intended that the following claims be interpreted as covering all such alterations and modifications as fall within the true spirit and scope of the invention.

I claim:

1. A portable ladder module for climbing a tree, comprising:

(a) a single primary support member having a first step;

(b) a single secondary support member having a second step, wherein said secondary support member is slidable relative to said primary support member; a central support member including a third step, wherein said primary support member and said secondary support member are telescopingly slidable within the central support member;

(c) locking means comprising a pair of upper locking holes in said central support member for selectively locking said primary support member in an extended and retracted position, and a pair of lower locking holes in said central support member for selectively locking said secondary support member in an extended and retracted position;

(d) single flexible means on said ladder module for suspending said ladder module from a tree, wherein said flexible means is placed in tension when weight is exerted on said ladder module; and (e) means on said primary support member and said secondary support member for stabilizing said ladder module against said tree and separating said primary support member and said secondary support member from said tree by a predetermined distance, wherein said stabilizing means includes edges which are caused to forcibly contact said tree and prevent movement of said ladder module against said tree when said flexible means is placed in said tension.

2. The ladder module of claim 1, wherein said first and second steps are wide enough to accommodate both shoes of a climber, and wherein each of said first and second steps includes a pair of retaining tabs extending upward and downward from each of the ends of said first and second steps.

3. The ladder module of claim 1, wherein said first and second steps each includes an upper and lower non-slip surface.

4. The ladder module of claim 1, wherein said third step includes a retaining tab extending upward and downward from the end of said third step.

5. The ladder module of claim 1, wherein said third step includes an upper and lower non-slip surface.

6. The ladder module of claim 1, wherein said means for attaching said ladder module to said tree comprises a flexible member having a quick-release buckle.

7. The ladder module of claim 1, wherein said means for attaching said ladder module to said tree comprises:

(a) a first slot formed through said primary support member;

(b) a second slot formed through said secondary support member, wherein said first slot and said second slot are alignable when said ladder module is retracted; and (c) a flexible member adapted to pass through said first slot or said second slot.

8. The ladder module of claim 1, wherein a first portion of said stabilizing means is attached to said first step, and a second portion of said stabilizing means is attached to said second step; wherein said first step is lockingly slidable relative to said primary support member; and wherein said second step is lockingly slidable relative to said secondary support member.

* * * * *